US011107670B2

(12) United States Patent
Aliman et al.

(10) Patent No.: US 11,107,670 B2
(45) Date of Patent: Aug. 31, 2021

(54) METHOD FOR ANALYZING A GAS BY MASS SPECTROMETRY, AND MASS SPECTROMETER

(71) Applicant: Leybold GmbH, Cologne (DE)

(72) Inventors: Michel Aliman, Oberkochen (DE); Alexander Laue, Heidenheim (DE); Andreas Schuetz, Aalen (DE); Ruediger Reuter, Aalen (DE)

(73) Assignee: Leybold GmbH, Cologne (DE)

( * ) Notice: Subject to any disclaimer, the term of this patent is extended or adjusted under 35 U.S.C. 154(b) by 0 days.

(21) Appl. No.: 16/687,236

(22) Filed: Nov. 18, 2019

(65) Prior Publication Data

US 2020/0090920 A1 Mar. 19, 2020

Related U.S. Application Data

(63) Continuation of application No. PCT/EP2018/061159, filed on May 2, 2018.

(30) Foreign Application Priority Data

May 29, 2017 (DE) ..... 10 2017 208 996.2

(51) Int. Cl.
*H01J 49/42* (2006.01)
*H01J 49/00* (2006.01)

(52) U.S. Cl.
CPC ..... *H01J 49/426* (2013.01); *H01J 49/0036* (2013.01); *H01J 49/422* (2013.01)

(58) Field of Classification Search
CPC .... H01J 49/426; H01J 49/0031; H01J 37/244; H01J 49/063; H01J 49/105; H01J 49/422; H01J 49/4285
(Continued)

(56) References Cited

U.S. PATENT DOCUMENTS 5,654,542 A * 8/1997 Schubert ..... H01J 49/428 250/282
9,035,245 B2 5/2015 Glasmachers et al.
(Continued)

FOREIGN PATENT DOCUMENTS

DE 10 2007 009 272 B3 5/2008
DE 102013208959 A1 11/2014
(Continued)

OTHER PUBLICATIONS

Translation of International Search Report for corresponding PCT Appl No. PCT/EP2018/061159, dated Jul. 20, 2018.
(Continued)

*Primary Examiner* — David A Vanore
(74) *Attorney, Agent, or Firm* — Theodore M. Magee; Westman, Champlin & Koehler, P.A.

(57) ABSTRACT

A method for analyzing a gas by mass spectrometry includes exciting ions of the gas to be analyzed in an FT ion trap, and recording a first frequency spectrum in a first measurement time interval during or after the excitation of the ions. The first frequency spectrum contains ion frequencies of the excited ions and interference frequencies. The method also includes recording a second frequency spectrum in a second measurement time interval. The second frequency spectrum contains the interference frequencies, but not the ion frequencies of the first frequency spectrum. The method further includes comparing the first frequency spectrum with the second frequency spectrum to identify the interference frequencies in the first frequency spectrum. The disclosure also relates to a mass spectrometer which is suitable for carrying out the method for analyzing the gas by mass spectrometry.

18 Claims, 5 Drawing Sheets

(58) Field of Classification Search
USPC ..... 250/281, 282, 288, 290, 292
See application file for complete search history.

(56) References Cited

U.S. PATENT DOCUMENTS

| | | | | |
|---|---|---|---|---|
| 10,141,174 | B2 | 11/2018 | Aliman et al. | |
| 2009/0084949 | A1 | 4/2009 | Franzen et al. | |
| 2014/0339424 | A1* | 11/2014 | Glasmachers | H01J 49/424 250/288 |
| 2015/0170898 | A1* | 6/2015 | Jiang | H01J 49/063 250/282 |
| 2016/0111269 | A1* | 4/2016 | Fedosenko | H01J 49/147 250/283 |
| 2017/0133214 | A1* | 5/2017 | Rafferty | H01J 49/4285 |
| 2017/0236683 | A1* | 8/2017 | Hegele | H01J 37/141 250/307 |
| 2017/0278690 | A1* | 9/2017 | Aliman | H01J 49/145 |
| 2018/0068842 | A1* | 3/2018 | Aliman | H01J 49/426 |
| 2018/0277346 | A1* | 9/2018 | Rusinov | H01J 49/38 |
| 2020/0090920 | A1* | 3/2020 | Aliman | H01J 49/422 |

FOREIGN PATENT DOCUMENTS

| | | | |
|---|---|---|---|
| DE | 10 2015 208 188 | A1 | 11/2016 |
| WO | WO 2015/003819 | A1 | 1/2015 |

OTHER PUBLICATIONS

M. Aliman and A. Glasmachers, "A novel electric ion resonance cell design with high signal-to-noise ratio and low distortion for Fourier transform mass spectrometry", Journal of The American Society for Mass Spectrometry; vol. 10, No. 10, Oct. 1999.

German Office Action, with translation thereof, for corresponding DE Appl No. 10 2017 208 996.2, dated May 14, 2018.

Translation of International Preliminary Report on patentability for corresponding PCT Appl No. PCT/EP2018/061159, dated May 2, 2018.

* cited by examiner

METHOD FOR ANALYZING A GAS BY MASS SPECTROMETRY, AND MASS SPECTROMETER

REFERENCE TO RELATED APPLICATIONS

This application claims the priority of the German Patent Application DE 10 2017 208 996.2 of May 29, 2017, the entire disclosure content of which is incorporated by reference in the content of this application.

FIELD

The disclosure relates to a method for analyzing a gas by mass spectrometry. The disclosure also relates to a mass spectrometer for carrying out the method, which has an ion trap, in particular an FT ion trap.

BACKGROUND

In an FT (Fourier Transform) ion trap, which is also referred to as an FFT (Fast Fourier Transform) ion trap, ions or ionized gas constituents can be measured in a non-reactive manner and without interruption, and can be verified or detected according to their mass-to-charge ratio, as described for example in the article: "A novel electric ion resonance cell design with high signal-to-noise ratio and low distortion for Fourier transform mass spectrometry", by M. Aliman and A. Glasmachers, Journal of The American Society for Mass Spectrometry; Vol. 10, No. 10, October 1999.

An example of a mass spectrometer with an electric FT ion trap is described in U.S. Pat. No. 9,035,245 B2. The FT ion trap has a ring electrode and two further electrodes (cap or measuring electrodes). The ions stored in the FT ion trap are excited in situ and the detection of the excited ions takes place by recording and evaluating mirror charges which the stored ions induce on the measuring electrodes of the FT ion trap. In order to measure mirror charges, the ions stored in the FT ion trap are excited (stimulated) in a broadband fashion in situ and oscillate at characteristic resonance frequencies in the ion trap, depending on the mass-to-charge ratio.

In order to induce the ion signal or the mirror charges at the measuring electrodes, the ions or the ion population are briefly excited. The excitation may take place for example differentially by way of the two measuring electrodes, in that any desired excitation pulse, for example in the form of a short differential voltage, is applied to the measuring electrodes.

It is known from WO 2015/003819 A1 in the case of an FT-ICR ("Fourier Transform Ion Cyclotron Resonance") trap to remove individual ion populations from the ion trap or suppress them if the number of particles thereof exceeds a predetermined threshold at a given mass-to-charge ratio by way of an IFT excitation in the form of a so-called SWIFT ("Storage Wave-Form Inverse Fourier Transform") excitation. In this way, it is possible to remove large ion populations from the ion trap, so that certain partial amounts of ion populations can be detected more accurately.

In an (electric) FT ion resonance cell or an FT ion trap, it is of great benefit if interference frequencies in the frequency spectrum recorded by the FT ion trap can be reliably detected, and possibly removed from the frequency spectrum, so that only "genuine" oscillations of the excited ions stored in the FT ion trap remain in the frequency spectrum. It should also be possible for all amounts of ion populations contained in the FT ion trap to be measured sufficiently accurately. It is also known to be of benefit to selectively excite or remove ion populations, for which possibly complex excitation algorithms may be used, as described for example in DE 10 2015 208 188 A1, which is briefly discussed below.

DE 10 2015 208 188 A1 describes a method for analyzing a gas by mass spectrometry and a mass spectrometer in which the generation and storage of ions in an FT ion trap and/or the excitation of the ions before the detection of the ions in the FT ion trap comprises at least one selective IFT ("Inverse Fourier transform") excitation dependent on the mass-to-charge ratio of the ions, in particular a SWIFT excitation.

In the case of an example described there, the ions in the FT ion trap are excited and a first frequency spectrum is recorded. After that, the phasing and/or the oscillation amplitude of the ions in the FT ion trap and/or the ion resonant frequencies of the ions in the FT ion trap are changed. The ions in the FT ion trap are then excited once again and a second frequency spectrum is recorded. By comparing the first and second recorded frequency spectra, interference frequencies in the FT ion trap are detected.

SUMMARY

The disclosure seeks to develop a method for analyzing a gas by mass spectrometry and an associated mass spectrometer in such a way that the capability of the analysis by mass spectrometry is improved.

According to a first aspect, a method for analyzing a gas by mass spectrometry, comprises: exciting ions of the gas to be analyzed in an FT ion trap, recording a first frequency spectrum in a first measuring time interval during or after the excitation of the ions, wherein the first frequency spectrum contains ion frequencies of the excited ions and interference frequencies, and recording a second frequency spectrum in a second measuring time interval, wherein the second frequency spectrum contains the interference frequencies but no ion frequencies of the first frequency spectrum, and comparing the first frequency spectrum with the second frequency spectrum to identify the interference frequencies in the first frequency spectrum.

The first frequency spectrum, which is recorded during the first measuring time interval, contains both (spectral) lines ("peaks") of the ion transients, which are attributable to excited ions stored in the FT ion trap, and lines of interference frequencies, which are attributable to parasitic interference signals in the FT ion trap, i.e. lines that were not caused by the excited ions. If the lines of the interference frequencies cannot be distinguished from the "genuine" ion frequencies, this may lead to a misinterpretation of the mass spectrum.

According to the disclosure, it is proposed for identifying the interference frequencies to record a second mass spectrum, preferably directly after or directly before the first measuring time interval, which differs from the first mass spectrum in that in the second frequency spectrum there are essentially the same interference frequencies as in the first frequency spectrum, but ultimately no ion frequencies. The expression "no ion frequencies" is understood in the context of this application as meaning that the ions do not make any contribution in the spectrum. This can be ensured by either the ions definitely being removed from the ion trap directly after or in the first measuring time interval by excessive excitation (overexcitation), or by the ions explicitly not being excited in the first place directly before the first measuring time interval.

The lines occurring in the second frequency spectrum can therefore be clearly assigned to the interference frequencies, so that the interference frequencies in the first frequency spectrum can be identified and marked in the first frequency spectrum, or possibly can be eliminated, i.e. deleted, from the first frequency spectrum. The first measuring time interval and the second measuring time interval generally do not overlap. However, it is also possible that there is a comparatively short time overlap between the first measuring time interval and the second measuring time interval, even if this is typically unfavorable for the measurement. In the context of this application, the terms frequency spectrum and mass spectrum are used synonymously, since a mass spectrum related to the mass-to-charge ratio of the ions can be clearly assigned to a frequency spectrum recorded via the FT ion trap for a given storage voltage form and storage voltage amplitude, and vice versa.

There are various possibilities for the recording of the second frequency spectrum, in which only the interference signals or the interference frequencies are present:

In one variant, the excited ions are removed from the FT ion trap at the beginning of the second measuring time interval or (directly) before the second measuring time interval, in particular at the end of the first measuring time interval. In this variant, the second measuring time interval follows the first measuring time interval in time. By removing the excited ions from the FT ion trap, it is ensured that there are no longer any ion frequencies in the second frequency spectrum, or that the corresponding ion signals decay very quickly in the second measuring time interval, typically at the beginning of the second measuring time interval, so that they are virtually no longer detectable in the second frequency spectrum. The removal of the excited ions from the FT ion trap may take place between the first measuring time interval and the second measuring time interval, but it is also possible that the ions are already removed from the FT ion trap during the first measuring time interval. In this case, a particularly quick measurement can be performed, since the second measuring time interval can follow directly after the first measuring time interval. However, in this case the resolution in a recording of the frequency or mass spectrum is typically lower, since the ions are not available for the measurement during the entire first measuring time interval.

In one variant, the ions are excited before the second measuring time interval, in particular before or in the first measuring time interval, with a (maximum) degree of excitation of at least 100%, preferably of at least 110%, in particular of at least 150%. The degree of excitation is understood as meaning the ratio between the maximum deflection in each case of the ions in the or along the axis of the measuring electrodes of the FT ion trap to the distance between the two measuring electrodes along the axis of the measuring electrodes. If the ions or the ion packets are excited with a degree of excitation of just 100%, they almost graze the measuring electrodes: The so-called Dehmelt potential represents a measure of this limit of the excitation energy. An excitation of the ions with a degree of excitation of more than 100% (Dehmelt potential exceeded) has the effect that the ions or ion packets concerned impinge on the measuring electrodes and are consequently "removed" from the ion population stored in the FT ion trap. If an excitation takes place with a degree of excitation of at least 100%, a very short time after the beginning of the excitation only interference signals or interference frequencies are present, since the "genuine" ion frequencies are quickly eliminated.

In a development, the overall amount of ions of the removed excited ions is determined during the removal of the excited ions from the FT ion trap. Since, during the removal from the ion trap, the excited ions impinge on the measuring electrodes in a short time (of the order of magnitude of less than 1 ms to a maximum of a few ms), the amount of ions, i.e. the absolute number of ions, of the ions removed from the FT ion trap can be determined on the basis of the strength of the detected measuring current (given suitable calibration). The cap electrodes are practically used as Faraday cups.

In a further development, the ion frequencies in the first frequency spectrum are assigned a respective individual amount of ions or an individual number of ions on the basis of the determined overall amount of ions. Since the peak heights, i.e. the heights of the spectral lines of the excited ions in the frequency spectrum, in relation to one another are known, a respective individual amount of ions can be assigned to the individual ion frequencies on the basis of the overall amount of ions determined in the way described further above. In this way, the ion frequencies or the associated spectral lines are allocated an ion-amount attribute, which can be indicated or displayed in the frequency spectrum.

The behavior of the ions stored in the FT ion trap can also be influenced in some other way such that, along with the heights of the spectral lines assigned to the respective ion frequencies or ion populations that are recorded in any case, further measuring characteristics (attributes) are assigned, for example the respective degree of excitation, the amounts of ions (see above), the phase position, the peak or line form, the dynamic range, the mass range, etc. On the basis of selected measuring methods and new attributes resulting from them—for example of the ion-amount attribute described further above—the evaluation of the ion signal can be greatly facilitated and systematized. All of these attributes can, depending on the application, be individually shown and hidden in the recorded frequency or mass spectra, to be more precise in their graphic representation.

In a further variant, the ions are excited with a degree of excitation of less than 100% before or in the first measuring time interval. In this case, the ions are typically only removed from the FT ion trap after the first measuring time interval (and before or in the second measuring time interval), in that they are typically excited with a degree of excitation of more than 100% before the second measuring time interval.

In a further variant, the second measuring time interval is at a time before the first measuring time interval. In this case, the second frequency spectrum is recorded before the ions are excited or the second measuring time interval has a sufficiently great time period in which the ions are not excited. If the ions are not excited or if the ions have lost their synchronous oscillation components due to multiple collisions, the oscillation components or the mirror charge components do not on average make any measurable spectral contributions at the measuring electrodes. In this way, the second frequency spectrum inevitably contains almost exclusively interference frequencies, but no ion frequencies. The ions that are excited are already stored in the FT ion trap during the entire second measuring time interval. This variant offers the advantage that a non-destructive measurement can be performed, i.e. that the ions do not have to be removed from the FT ion trap for the recording of the second frequency spectrum.

In a further variant, the first measuring time interval and the second measuring time interval follow one another with a time difference of less than 10 ms, preferably of less than 5 ms, in particular of less than 1 ms. For a meaningful measurement of the interference frequencies or the interference signals, it has proven to be favorable if the two measuring time intervals follow one another as closely as possible in time.

In a further variant, there is a time period from the beginning of the first measuring time interval to the end of the second measuring time interval or vice versa (i.e. if the second measuring time interval is at a time before the first measuring time interval) of less than 500 ms. In order to obtain a meaningful measurement of the interference frequencies, it is advantageous if the two measuring time intervals are as short as possible. Depending on the desired oscillation resolution, the entire measuring time, which comprises the two measuring time intervals and possibly further time intervals for the excitation, may be of the order of magnitude of one millisecond to hundreds of milliseconds.

In a further variant, the excitation of the ions takes place by a selective IFT ("Inverse Fourier Transform") excitation, in particular a SWIFT ("Storage Wave Form Inverse Fourier Transform") excitation, that is dependent on the mass-to-charge ratio of the ions (or is frequency-dependent). In particular in an electric FT ion trap, it is possible that unwanted ions, which should not be stored in the FT ion trap and which lie in a predetermined interval of the mass-to-charge ratio or a predetermined frequency range of the ion frequencies (wherein the interval or the frequency range may have a plurality of non-contiguous sub-intervals), are excessively excited via a SWIFT excitation (i.e. with a degree of excitation greater than 100%), so that these ions are lost to the surrounding electrodes of the FT ion trap and only the ions to be stored, which have the desired mass-to-charge ratios, remain in the FT ion trap and are stored there.

In a further variant, frequencies contained in the first frequency spectrum that lie in a frequency range in which no excitation of ions or an excitation of ions with a degree of excitation of more than 100% takes place are identified as interference frequencies or as interference signals. If the excitation of the ions, for example via an IFT or SWIFT excitation, is suitably chosen, it can be ruled out in certain frequency ranges of the recorded frequency spectrum that ion signals or ion frequencies are present there. Lines or frequencies that are present in these frequency ranges are certain to be spectral lines that are assigned to interference frequencies. This is typically the case if the ions are excited in a respective frequency range with a degree of excitation of more than 100% or not at all.

A further aspect of the disclosure relates to a mass spectrometer, comprising: an FT ion trap, an excitation device for exciting ions in the FT ion trap, a detector, which is designed to record a first frequency spectrum in a first measuring time interval during or after the excitation of the ions, wherein the first frequency spectrum contains ion frequencies of the excited ions and interference frequencies, and also to record a second frequency spectrum in a second measuring time interval, wherein the second frequency spectrum contains the interference frequencies, but no ion frequencies of the first frequency spectrum, and also that the detector is designed to identify the interference frequencies in the first frequency spectrum by comparing the first frequency spectrum with the second frequency spectrum. The mass spectrometer described here is consequently suitable for carrying out the method described further above.

It has been found to be favorable if the FT ion trap is designed as an electric FT ion trap, i.e. the mass spectrometer is an electric ion resonance mass analyzer, in which the ions are dynamically stored by a high-frequency alternating field. The mass spectrometer may be designed in particular for ionizing the gas to be analyzed in the FT ion trap. For this purpose, the mass spectrometer may have a device for supplying electrons and/or an ionization gas into the FT ion trap.

The FTI ion trap may for example be designed as an FT-ICR ion trap or as an Orbitrap. For carrying out fast measurements, mass spectrometry via a Fourier transform can in principle be carried out with different types of FT ion traps, wherein the combination with the so-called ion cyclotron resonance ion trap (FT-ICR ion trap) is the one that is most commonly used. In the FT-ICR ion trap, which may be designed as a magnetic or electric ICR ion trap, mass spectrometry is carried out via cyclotron resonance excitation. The so-called Orbitrap has a central, spindle-shaped electrode, around which the ions are kept in orbits by electric attraction, wherein an oscillation along the axis of the central electrode is produced by a decentral injection of the ions, the oscillation producing signals in the detector plates which can be detected in a similar fashion to the FT-ICR ion trap (by FT). It is understood that the mass spectrometer can also be operated in combination with other types of FT ion traps, i.e. with ion traps in which an induction current that is generated on measuring electrodes by the stored ions is detected and amplified in a time-dependent manner.

In one embodiment, the excitation device is designed to remove the excited ions from the FT ion trap at the beginning of the second measuring time interval or before the second measuring time interval, in particular at the end of the first measuring time interval, to be precise preferably by exciting with a degree of excitation of at least 100%. As described further above, the ions may be removed from the FT ion trap by exciting with a degree of excitation of at least 100%, wherein the ions can typically be removed from the FT ion trap all the faster the greater the degree of excitation is.

In a development, the detector is designed to determine the overall amount of ions of the removed excited ions during the removal of the excited ions from the FT ion trap. As described above, such a determination may take place on the basis of the ion current at the measuring electrodes that is detected during the removal of the ions, since the ions are removed from the FT ion trap by way of the measuring electrodes. The amount of ions of the ions contained in the FT ion trap can be determined on the basis of the rapidly decaying, quasi-linear temporal change in the ion current at the measuring electrodes, i.e. with an approximately uniform ion loss rate at the measuring electrodes.

In a further development, the detector is designed to assign a respective individual amount of ions or an absolute number of ions to the ion frequencies in the first frequency spectrum on the basis of the overall amount of ions determined. Since the line heights or the peak heights of the excited ions in the frequency spectrum in relation to one another are known, a respective individual amount of ions can be assigned as an ion attribute to the individual ion frequencies or their spectral lines on the basis of the overall amount of ions known in the absolute value.

In a further embodiment, the excitation device is designed to excite the ions by a selective IFT excitation, in particular a SWIFT excitation, dependent on the mass-to-charge ratio of the ions. If the excitation of the ions, for example via an IFT or SWIFT excitation, is suitably chosen, ions can be specifically removed from the ion trap in certain frequency ranges that correspond to predetermined mass-to-charge ratios of the ions. Frequency ranges in which no excitation or an excitation with a degree of excitation of more than 100% takes place, in which therefore no ion signals are present, can also be identified in the first frequency spectrum, so that only interference frequencies occur there, and these can be eliminated from the first frequency spectrum.

Further features and advantages of the disclosure are evident from the following description of exemplary embodiments of the disclosure, with reference to the figures of the drawing, which show details of the disclosure, and from the claims. The individual features may be realized in each case individually by themselves or as a plurality in any desired combination in a variant of the disclosure.

BRIEF DESCRIPTION OF THE DRAWINGS

Exemplary embodiments are illustrated in the schematic drawing and are explained in the following description. In the drawing.

DESCRIPTION OF EXEMPLARY EMBODIMENTS

In the following description of the drawings, identical reference signs are used for identical or functionally identical components, respectively.

Figure 1:
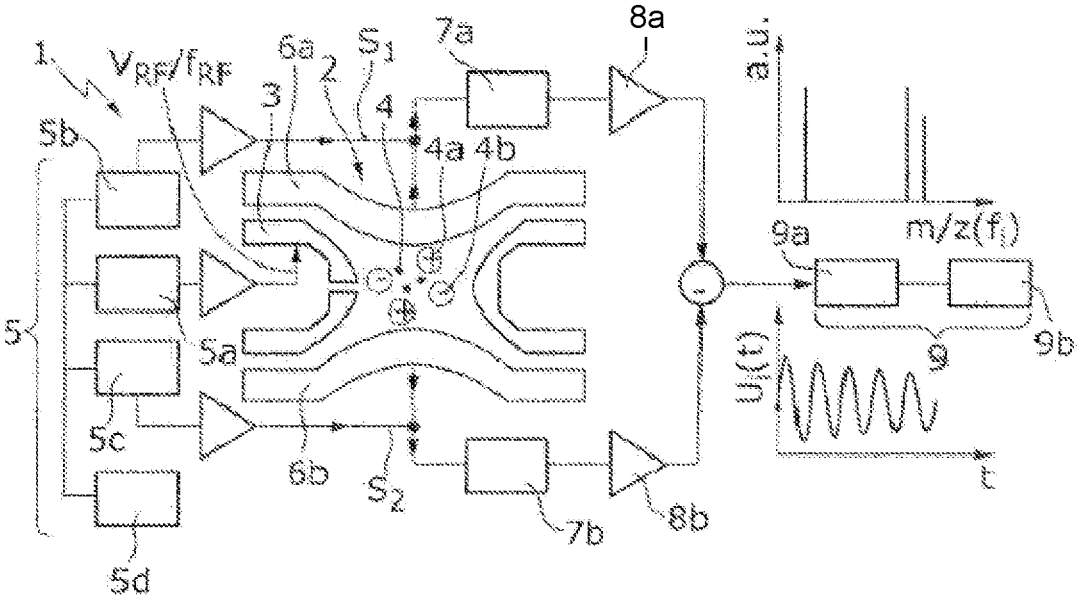
FIG. 1 shows a schematic representation of a mass spectrometer with an electric FT-ICR ion trap and with an excitation device for exciting ions.

FIG. 1 schematically shows a mass spectrometer 1 which has an electric FT-ICR ion trap 2. The FT-ICR ion trap 2 has a ring electrode 3, applied to which is a high-frequency AC voltage $V_{RF}$, which may have for example a frequency $f_{RF}$ of the order of magnitude of kHz to MHz, e.g. 1 MHz, and an amplitude $V_{RF}$ of several hundred volts. The high-frequency AC voltage $V_{RF}$ produces in the FT-ICR ion trap 2 a high-frequency alternating field in which ions 4*a*, 4*b* of a gas 4 to be analyzed are dynamically stored.

From the high-frequency alternating field (E-field), there results an average restoring force that acts on the ions 4*a*, 4*b* all the more strongly the further away the ions 4*a*, 4*b* are from the middle or center of the FT-ICR ion trap 2. To measure the mass-to-charge ratio (m/z) of the ions 4*a*, 4*b*, the latter are excited by an excitation signal S1, S2 (stimulus) to carry out oscillations, the frequency $f_i$ of which is dependent on the ion mass and the ion charge and is typically in the frequency range of kHz to MHz orders of magnitude, e.g. from about 1 kHz to 200 kHz. The respective excitation signal S1, S2 is produced by a second excitation unit 5B and a third excitation unit 5*c* which forms an excitation device 5 together with a first excitation unit 5*a*, which serves for producing the high-frequency storage voltage $V_{RF}$ with the predetermined storage frequency $f_{RF}$. The excitation device 5 also has a synchronization device 5*d*, which synchronizes the three excitation units 5*a-c* in time. Downstream of each excitation unit 5*a-c* is an amplifier, which is likewise part of the excitation device 5.

For a non-reactive, non-destructive detection (i.e. the ions 4*a*, 4*b* are still present after the detection), the oscillation signals of the ions 4*a*, 4*b* are tapped in the form of induced mirror charges at the measuring electrodes 6*a*, 6*b*, as described for example in DE 10 2013 208 959 A, which was cited at the beginning, the entirety of which is incorporated into the content of this application by reference. As described in detail there, the respective measuring electrodes 6*a*, 6*b* are respectively connected to a low-noise charge amplifier 8*a*, 8*b* by way of a filter 7*a*, 7*b*. The charge amplifiers 8*a*, 8*b* on the one hand capture and amplify the ion signals from the two measuring electrodes 6*a*, 6*b* and on the other hand keep the measuring electrodes 6*a*, 6*b* at the virtual ground potential for the storage frequency $f_{RF}$. By forming the difference from the signals supplied by the charge amplifiers 8*a*, 8*b*, an ion signal $u_i(t)$ is produced, the variation over time of which is shown at the bottom right in FIG. 1.

The ion signal $u_i(t)$ is fed to a detector 9, which, in the example shown, has an analog-to-digital converter 9*a* and a spectrometer 9*b* for fast Fourier analysis (FFT) in order to produce a mass spectrum, which is shown by way of example at the top right in FIG. 1. In this case, the detector 9 or the spectrometer 9*b* firstly produces a frequency spectrum of the characteristic ion resonance frequencies $f_i$ of the ions 4*a*, 4*b* stored in the FT-ICR ion trap 2, which is converted into a mass spectrum on the basis of the dependence of the ion resonance frequencies $f_i$ on the mass and charge of the respective ions 4*a*, 4*b*. In the mass spectrum, the number of detected particles or charges in dependence on the mass-to-charge ratio m/z is shown.

Consequently, the electric FT-ICR ion trap 2 allows a direct detection or the direct recording of a mass spectrum, as a result of which a quick gas analysis is made possible. However, the fast recording of a mass spectrum with the aid of Fourier spectrometry can be performed not only in the electric FT-ICR ion trap 2 described above, but also in variations of the type of trap shown in FIG. 1, for example in the case of a so-called toroidal trap or in the case of a differently shaped FT ion trap, such as, for example, in the case of a so-called Orbitrap.

As described further above, all of the ions 4*a*, 4*b* in the FT-ICR ion trap 2 have an ion frequency $f_i$ which is proportional to their mass-to-charge ratio (m/z) and with which the stored ions 4*a*, 4*b* oscillate in the FT-ICR ion trap 2. If the ions 4*a*, 4*b* are excited at their respective ion frequency $f_i$, they either can be excited in a targeted manner in this way or be thrown out of the FT-ICR ion trap 2 by a resonance step-up, i.e. by an excitation with a degree of excitation of 100% or more. Consequently, ions 4*a*, 4*b* with certain mass-to-m charge ratios m/z can be selectively excited or their storage in the FT-ICR ion trap 2 can be prevented/suppressed.

The generalization of this principle leads to one or more regions ("windows") in the ion resonance frequency range, in which ions 4*a*, 4*b* whose ion resonance frequency $f_i$ lies within the respective window can be excited or suppressed in a targeted manner. The inverse transformation of these regions by way of an inverse Fourier transform supplies the time signal used for the so-called IFT excitation. If these variations over time are calculated in advance, this is referred to as SWIFT excitation. The measuring electrodes 6*a*, 6*b* can be used for such a SWIFT excitation. By the SWIFT excitation, the ions 4*a*, 4*b* can be deflected in the direction of the measuring electrodes 6*a*, 6*b* in such a way that both during the ion production and ion storage and also immediately before the detection of the ion signals $u_i(t)$ certain ions 4*a*, 4*b* are on the one hand either stored or not stored and on the other hand are excited virtually continuously or not excited at all.

In principle, there are two possibilities for producing the ions 4*a*, 4*b* by ionizing the gas 4: either the ions 4*a*, 4*b* are produced outside the FT-ICR ion trap 2 or the gas 4 is fed to the FT-ICR ion trap 2 in a charge-neutral form and the ionization takes place in the FT-ICR ion trap 2. For example, such an ionization in the FT-ICR ion trap 2 can be carried out in the way described in WO 2015/003819 A1, which was cited at the beginning and is incorporated into the content of this application with respect to this aspect by reference. Parasitic interference frequencies $f_n$ that lead to spectral lines in the recorded mass spectrum which are not attributable to the excited ions 4*a*, 4*b* stored in the FT-ICR ion trap 2 may occur in the FT-ICR ion trap 2 when recording mass spectra via the mass spectrometer 1. Such interference frequencies $f_n$ may lead to a misinterpretation of the mass spectrum.

In order to identify, and possibly eliminate, interference frequencies $f_n$ in the mass spectrum, a method that is described in more detail below on the basis of FIG. 2 may be used:

In a first step of the method, the ions 4*a*, 4*b* in the FT-ICR ion trap 2 are excited for a short time in an excitation time interval $\Delta t_{S1}$ via a SWIFT excitation. The degree of excitation A in the SWIFT excitation is at a maximum of about 90%, so that the excited ions 4*a*, 4*b* remain in the FT-ICR ion trap 2 and are not removed from it. After the excitation, the excited ions 4*a*, 4*b* are detected in a first measuring time interval FFT1, in which the mirror charges induced at the measuring electrodes 6*a*, 6*b* are recorded via the detector 9. In this case, the ion oscillations or the ion signals decay with characteristic decay time constants, which depend inter alia on the average free path length of the molecules or of the ions 4*a*, 4*b* in the FT-ICR ion trap 2.

Figure 5A:
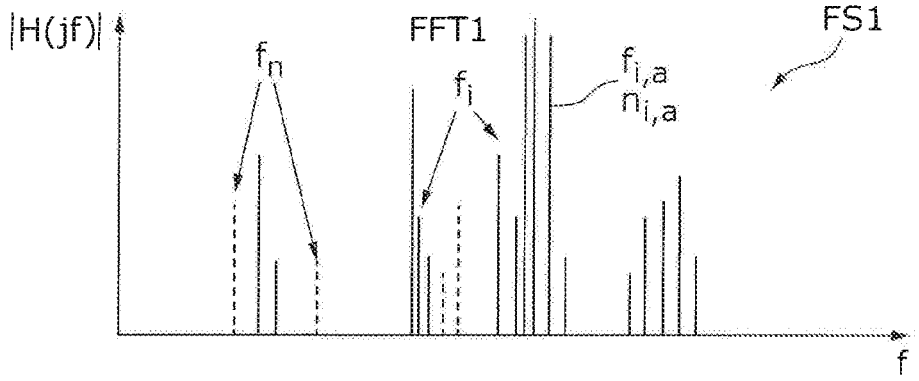
FIG. 5A, 5B show schematic representations of the first and second recorded frequency spectra.

FIG. 5A shows a first frequency spectrum FS1, which is recorded in the first measuring time interval FFT1—corresponding to a first measuring time window of a Fast Fourier Transform. As can be seen in FIG. 5A, in the first frequency spectrum FS1 there are not only spectral lines or peaks that correspond to ion frequencies $f_i$ of the excited ions 4*a*, 4*b* but also spectral lines that correspond to parasitic interference frequencies $f_n$ in the FT-ICR ion trap 2. The interference frequencies $f_n$ are not produced by the excited ions 4*a*, 4*b*, and may therefore lead to a misinterpretation of the mass spectrum.

In order to identify the interference frequencies $f_n$ in the first frequency spectrum FFT1, after the first measuring time interval FFT1 the ions 4*a*, 4*b* are excited once again in a second excitation interval $\Delta t_{S2}$ via a SWIFT excitation, wherein a maximum degree of excitation A of about 150% is chosen in this case for the excitation. The high degree of excitation A causes the excited ions 4*a*, 4*b* to impinge on the measuring electrodes 6*a*, 6*b* and to be removed quickly from the FT-ICR ion trap 2. In a decay time interval $\Delta t_{EX}$ directly following the second excitation time interval $\Delta t_{S2}$ and directly before the second measuring time interval FFT2, the (normalized) ion signal $u_i(t)$, to be more precise its component attributable to the ion frequencies $f_i$, only the envelope of which is shown in FIG. 2, decays very quickly and steeply.

Figure 5B:
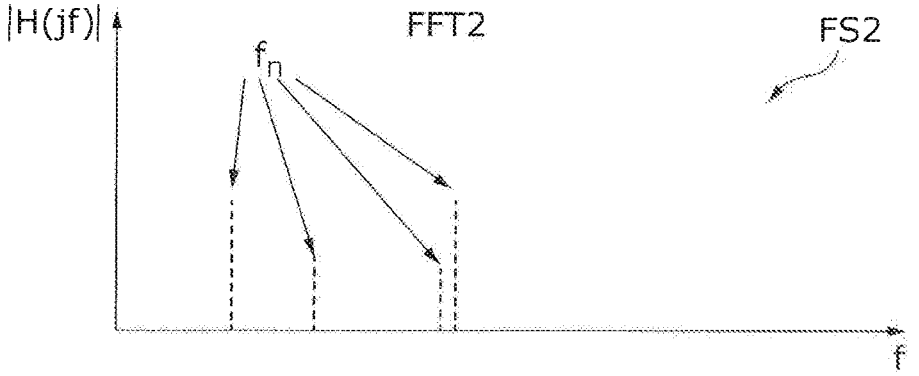

In a frequency spectrum FS2 recorded in the second measuring time interval FFT2 and shown in FIG. 5B, the ion frequencies $f_1$ can no longer be seen, since they have a much smaller line height in comparison with the interference frequencies $f_n$ that are present in the second frequency spectrum FS2, or have been eliminated virtually completely. By a comparison of the second frequency spectrum FS2, shown in FIG. 5B, with the first frequency spectrum FS1, shown in FIG. 5A, the interference frequencies $f_n$ in the first frequency spectrum FS1 can be identified and correspondingly marked, as can be seen in FIG. 5A, in which the interference frequencies $f_n$ are represented by broken lines and the ion frequencies $f_i$ are represented by solid lines. Optionally, the interference frequencies $f_n$ may be eliminated from the first frequency spectrum FS1 in the detector 9, to be more precise in the spectrometer 9*b*, so that only the "genuine" ion frequencies $f_1$ can be seen in the representation or the display of the first frequency spectrum FS1. For example, a number of 8 kilo samples (kS), 16 kS, 32 kS or 64 kS may be recorded in the respective measuring time intervals FFT1, FFT2.

Figure 2:
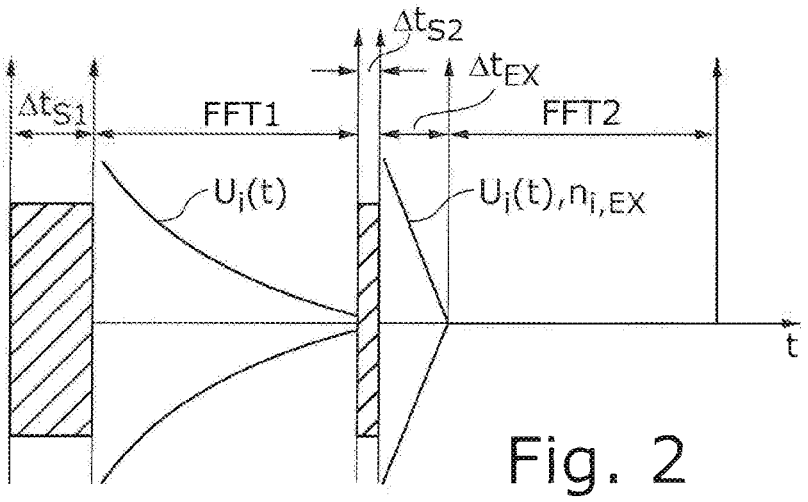
FIG. 2 shows a schematic representation of a time sequence with a first measuring time interval for recording a first frequency spectrum, in which ion frequencies and interference frequencies are contained, and a second measuring time interval for recording a second frequency spectrum, in which interference frequencies but no ion frequencies are present.
Figure 3:
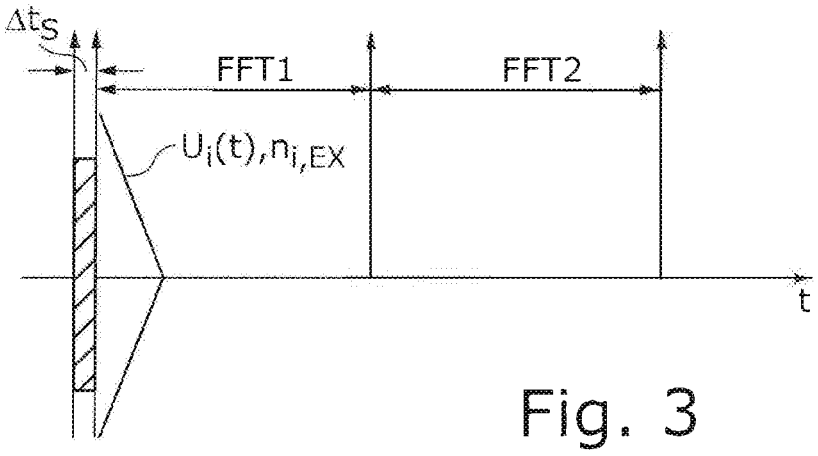
FIG. 3 shows a schematic representation analogous to FIG. 2, in which the ions are excited with a degree of excitation of more than 100% before a first measuring time interval for recording the first frequency spectrum.

FIG. 3 shows the time sequence of the recording of a first frequency spectrum FS1 and a second frequency spectrum FS2 for identifying interference frequencies $f_n$ in the first frequency spectrum FS1, which differs from the sequence shown in FIG. 2 in that, in an excitation time interval $\Delta t_S$ before the first measuring time interval FFT1, an excitation of the ions 4*a*, 4*b* with a "gentle" superexcitation takes place, with a maximum degree of excitation A of little more than 100%, to be specific of about 110%. In this way, the ions 4*a*, 4*b* are already removed from the FT ion trap 2 in the first measuring time interval FFT1, to be more precise at the beginning of the first measuring time interval FFT1.

Correspondingly, the (normalized) ion signal $u_i(t)$, of which only the envelope is shown in FIG. 3, decays quickly and steeply at the beginning of the first measuring time interval FFT1, so that the stored ions 4*a*, 4*b* or the stored ion populations are removed completely from the FT ion trap 2. The first frequency spectrum FS1, which is shown in FIG. 5A and, as described in connection with FIG. 2, contains both ion frequencies $f_i$ and interference frequencies $f_n$, is recorded on the basis of the mirror charges at the measuring electrodes 6*a*, 6*b* in the first measuring time interval FFT1.

Since the ions 4*a*, 4*b* have been completely removed from the FT ion trap 2 in the first measuring time interval FFT1, there are no longer any excited ions 4*a*, 4*b* in the FT ion trap 2 in the case of the time sequence shown in FIG. 3 in the second measuring time interval FFT2, which follows on directly after the first measuring time interval FFT1. Correspondingly, only interference frequencies $f_n$ but no longer any "genuine" ion frequencies $f_i$ are detected in the recording of the second frequency spectrum FS2 in the second measuring time interval FFT2.

In the examples shown in FIG. 2 and in FIG. 3, the excited ions 4*a*, 4*b* are completely removed from the FT ion trap 2 directly before the second measuring time interval FFT2 or in the first measuring time interval FFT1. During the removal of the ions 4*a*, 4*b*, the comparatively steep ion signal $u_i(t)$ shown in FIG. 2 and in FIG. 3 is recorded, on the basis of the slope or decay rate of which, to be more precise on the basis of the signal strength $u_{i,s}$ of which at the beginning of the decay time interval $\Delta t_{EX}$ or the first measuring time interval FFT1, the overall amount of ions $n_{i,ex}$ (i.e. the overall number of ions) of the excited ions 4*a*, 4*b* removed from the FT ion trap 2 is determined.

Figure 7A:
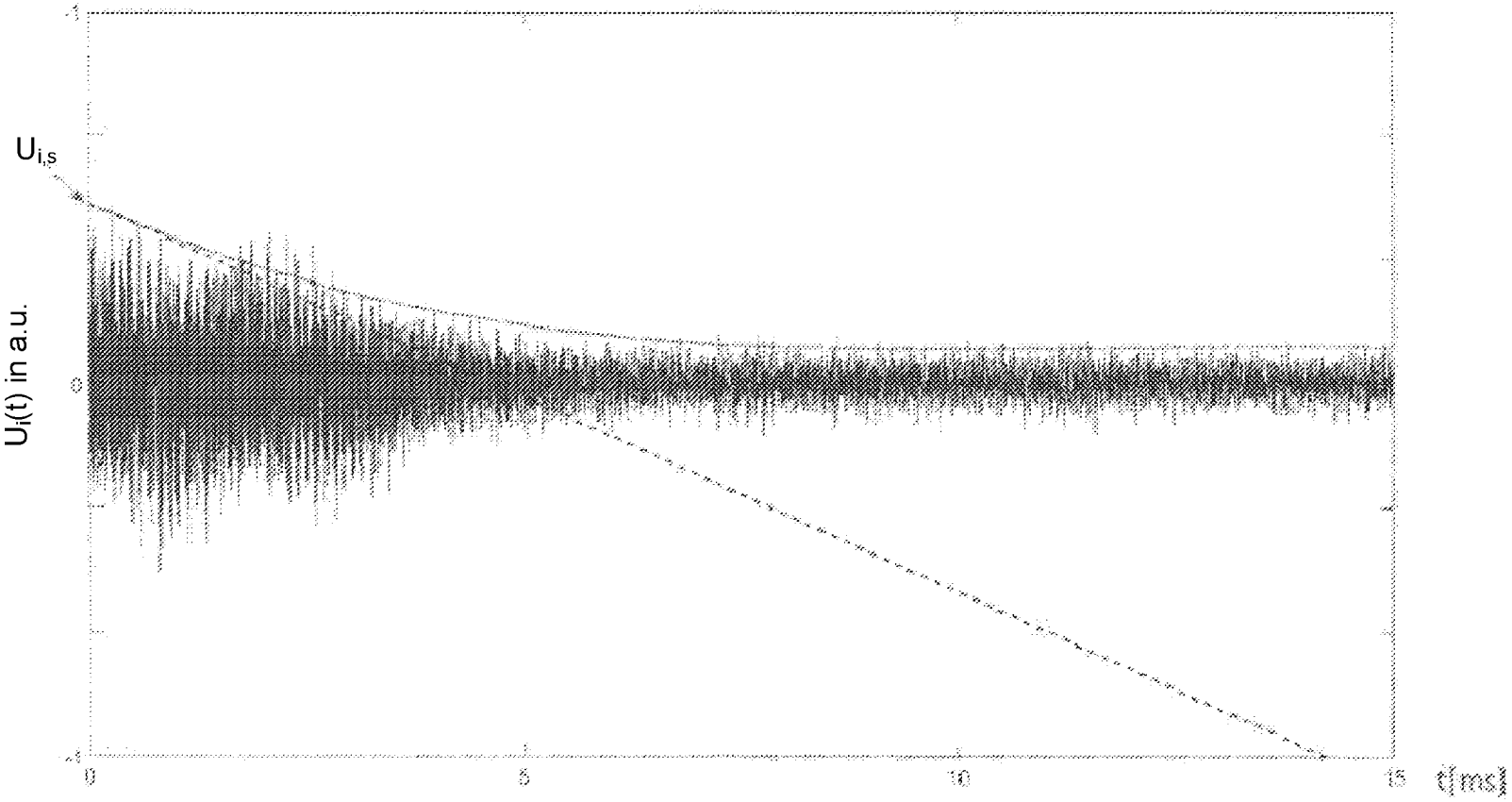

FIG. 7A shows an example of an ion signal $u_i(t)$ which is recorded during a measurement and contains both the ion frequencies $f_i$ and the interference frequencies $f_n$. The ion signal $u_i(t)$ has an envelope in the form of a decaying exponential function, which is likewise shown in FIG. 7A. The signal component that contains the ion frequencies $f_1$ has a linear decay curve, likewise shown in FIG. 7A, in the form of a straight line, which at the point in time t=0 forms a tangent to the exponential function and which at the point in time t=5 ms has a zero transition, i.e. at the point in time t=5 ms the ions have been removed virtually completely from the FT ion trap 2. Given suitable calibration of the FT ion trap 2, the amplitude $u_{i,s}$ of the envelope of the ion signal $u_i(t)$ at the point in time t=0 ms may be brought into a relationship with the overall amount of ions $n_{i,ex}$ in the FT ion trap 2, wherein the following applies to the ion signal $u_i(t)$ represented by way of example in FIG. 7A: $n_{i,ex}$=24211, which altogether corresponds approximately to a population of twenty four thousand ions.

Figure 7B:
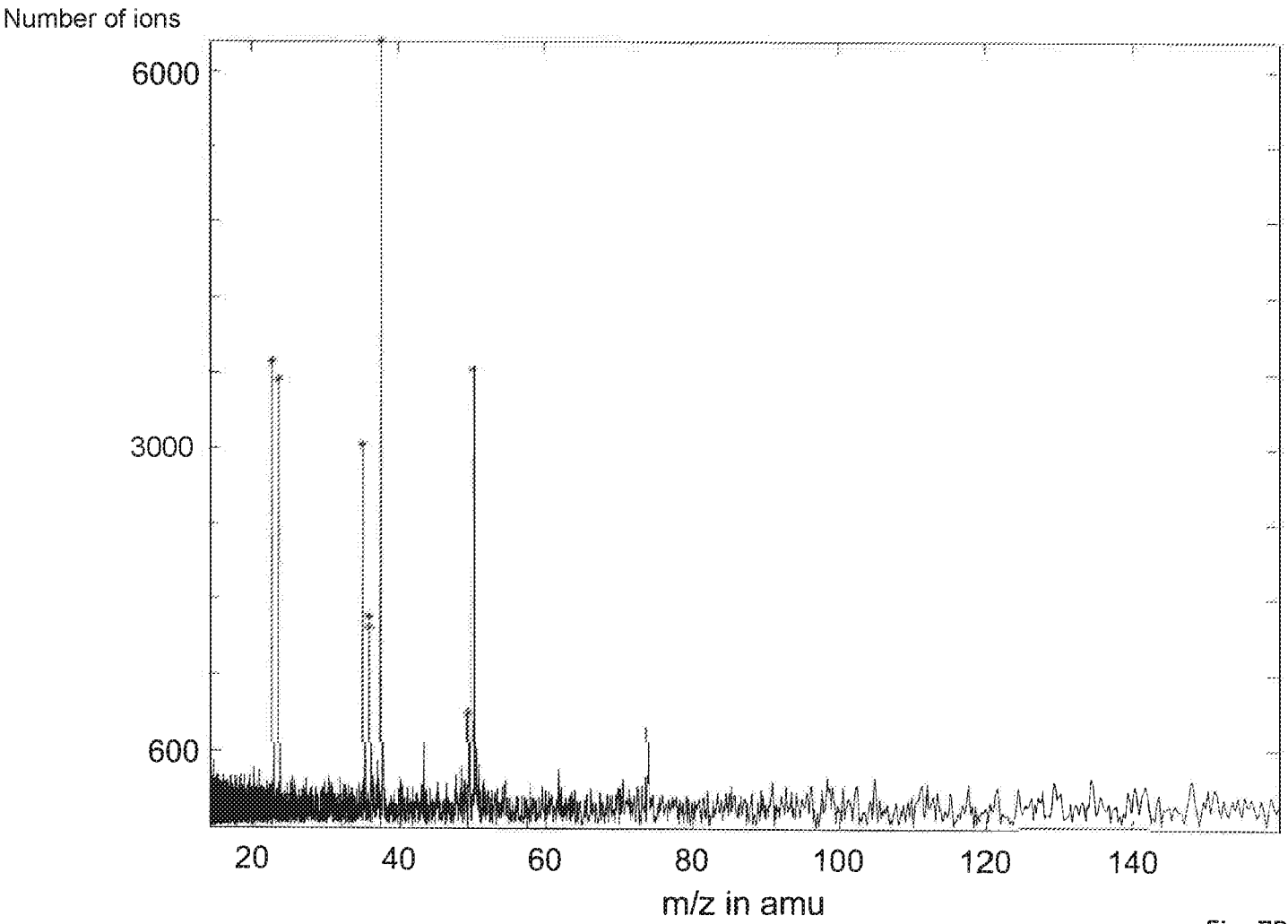

In the case of the first frequency spectrum FS1 shown in FIG. 5A, in principle only the relative proportion of the individual ion frequencies $f_{i,a}$ in the overall amount or in the overall number of excited ions 4*a*, 4*b* in the FT ion trap 2 is known on the basis of the height of the spectral lines thereof. On the other hand, the absolute amount of the ions 4*a*, 4*b* at the respective individual ion frequencies $f_{i,a}$ in the FT ion trap 2 is not known in the case of conventional mass spectra. However, by the destructive measurement described in FIG. 2 and in FIG. 3, in which the ions 4*a*, 4*b* are removed from the FT ion trap 2, the overall amount $n_{i,ex}$ of the excited ions 4*a*, 4*b* can be determined in the way described further above. On the basis of the ratio of the respective heights of the spectral lines measured at the individual ion frequencies $f_{i,a}$ to the sum of the heights of all of the spectral lines present in the first frequency spectrum FS1, it is possible to determine for the respective ion frequencies $f_{i,a}$ the amount of ions $n_{i,a}$ or the number of ions individually for each individual ion frequency $f_{i,a}$. FIG. 7B shows a mass spectrum belonging to the ion signal $u_i(t)$ from FIG. 7A (in dependence on the mass-to-charge ratio m/z in amu), in the case of which the respective ion frequencies $f_{i,a}$ or the mass-to-charge ratios $(m/z)_a$ corresponding to them are assigned an individual number of ions $n_{i,a}$, to be precise in the case of the example shown in FIG. 7B as follows: $(m/z)_1$=50.40, $n_{i,1}$=827; $(m/z)_2$=50.20, $n_{i,2}$=3652; $(m/z)_3$=49.59, $n_{i,3}$=927; $(m/z)_4$=37.69, $n_{i,4}$=6318; $(m/z)_5$=36.12, $n_{i,5}$=1319; $(m/z)_6$=36.10, $n_{i,6}$=1399; $(m/z)_7$=35.24, $n_{i,7}$=2651; $(m/z)_8$=23.68, $n_{i,8}$=3474; $(m/z)_9$=22.78; $n_{i,9}$=3640.

Figure 4:
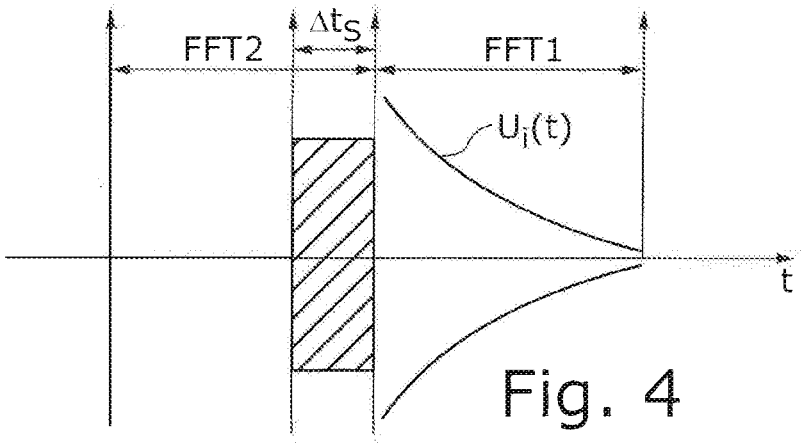
FIG. 4 shows a schematic representation analogous to FIG. 3, in which the second frequency spectrum is recorded in a second measuring time interval, which is at a time before the first measuring time interval.

FIG. 4 shows the time sequence of a measurement in which the sequence over time of the first measuring time interval FFT1 and the second measuring time interval FFT2 is changed over, i.e. the first measuring time interval FFT1 follows the second measuring time interval FFT2 in time. In the example shown, the second frequency spectrum FS2 is recorded before the excitation of the ions 4*a*, 4*b*. To be more precise, in the example shown the excitation of the ions 4*a*, 4*b* takes place in an excitation time interval $\Delta t_s$, which is directly before the end of the second measuring time interval FFT2 and therefore overlaps with it.

The excitation of the ions 4*a*, 4*b* in the excitation time interval $\Delta t_s$ takes place with a degree of excitation A of less than 100%, so that the excited ions 4*a*, 4*b* are not removed from the FT ion trap 2. Therefore, in the first measuring time interval FFT1, following on directly after the second measuring time interval FFT2, the excited ions 4*a*, 4*b* can be detected in a non-reactive manner.

As described further above in connection with FIG. 2 and FIG. 3, only interference frequencies $f_n$, but no ion frequencies $f_i$, are contained in the second frequency spectrum FS2, since the excitation of the ions 4*a*, 4*b* only takes place at the end of the second measuring time interval FFT2. It goes without saying that, in the case where signals or spectral lines with too great a height already occur during the excitation, the excitation time interval $\Delta t_s$ can only begin after the second measuring time interval FFT2, so that no excitation of ions 4*a*, 4*b* takes place in the second measuring time interval FFT2. In this case, the excitation time interval $\Delta t_s$ lies between the second measuring time interval FFT2 and the first measuring time interval FFT1.

For a meaningful measurement of the interference frequencies $f_n$ or the interference signals, it is generally favorable if the time difference between the first measuring time interval FFT1 and the second measuring time interval FFT2 is as small as possible. Ideally, the second measuring time interval FFT2 follows the first measuring time interval FFT1 (or vice versa) at a time difference $\Delta t_s$ of less than about 10 ms, less than 5 ms or ideally of less than 1 ms. Altogether, it is advantageous if the entire measurement proceeds as quickly as possible, i.e. if the time period between the beginning of the first measuring time interval FFT1 and the end of the second measuring time interval FFT2 is as small as possible, for example if it is less than about 500 ms, or if the two measuring time intervals FFT1, FFT2 are as short as possible. The time period of the measurement may vary in dependence on the desired mass resolution or oscillation resolution, for example in an order of magnitude of between one millisecond and several hundred milliseconds. The time period of the measurement is made up of the time period of the two measuring time intervals FFT1, FFT2 and, in the case of the example shown in FIG. 2, additionally the time period of the excitation time interval $\Delta t_{S2}$ as well as the decay time interval $\Delta t_{EX}$, since these lie between the first and second measuring time intervals FFT1, FFT2. The time period of the first excitation time interval $\Delta t_{S2}$ from FIG. 2 and the excitation time interval $\Delta t_S$ from FIG. 3 in each case lies before the first measuring time interval FFT1, and is therefore ignored in the determination of the overall time.

Figure 6:
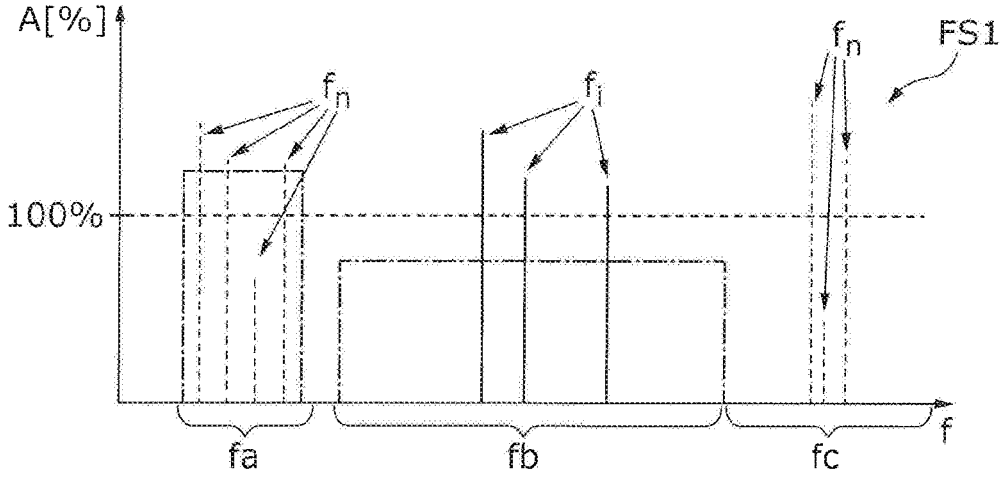
FIG. 6 shows a schematic representation of a first frequency spectrum with interference frequencies in frequency ranges in which no excitation or an excitation with a degree of excitation of more than 100% takes place, and FIG. 7*a,b* show schematic representations of the variation over time of an ion signal during the removal of ions from the ion trap for the determination of an overall amount of ions, and also a mass spectrum with ion frequencies or m/z ratios to which individual amounts of ions are assigned.

Shown in FIG. 6 is a (first) frequency spectrum FS1, which has three frequency ranges $f_a$, $f_b$, $f_c$. In the first frequency range $f_a$ and in the second frequency range $f_b$, a SWIFT excitation that is frequency-dependent, and consequently dependent on the mass-to-charge ratio m/z, takes place in each case, wherein the degree of excitation A in the first frequency range $f_a$ is about 120% and in the second frequency range $f_b$ is about 90%. No excitation of the ions 4*a*, 4*b* takes place in the third frequency range $f_c$.

Since in the first frequency range the ions 4*a*, 4*b* are excited with a degree of excitation A of significantly more than 100%, no ion frequencies $f_i$ or ion signals can occur there. Therefore, the frequencies which, in FIG. 6, are present in the first frequency range $f_a$ can be clearly identified as interference frequencies $f_n$. The same applies to the frequencies or spectral lines present in the third frequency range $f_c$, which likewise cannot be ion frequencies $f_i$ because of the absent excitation, so that these can be clearly identified as interference frequencies $f_n$. Ion oscillations or ion frequencies $f_i$ can only occur in the second frequency range $f_b$, in which an excitation with a degree of excitation A of less than 100% takes place. It goes without saying that it cannot be ruled out that there are also interference frequencies $f_n$ in the second frequency range $f_b$. These can however be identified in the way described further above in connection with FIG. 2 to FIG. 4, and if desired be eliminated from the first frequency spectrum FFT1.

What is claimed is:

1. A method, comprising:

exciting ions of a gas in an FT ion trap;

recording a first frequency spectrum in a first measuring time interval during or after the excitation of the ions, the first frequency spectrum comprising ion frequencies of the excited ions and interference frequencies;

recording a second frequency spectrum in a second measuring time interval, the second frequency spectrum comprising the interference frequencies of the first frequency spectrum but not the ion frequencies of the first frequency spectrum;

removing the excited ions from the FT ion trap at a time selected from the group consisting of the beginning of the second measuring time interval and before the second measuring time interval; and comparing the first and second frequency spectra to identify the interference frequencies of the first frequency spectrum.

2. The method of claim 1, wherein the excited ions are removed from the FT ion trap at the end of the first measuring time interval.

3. The method of claim 1, wherein, before the second measuring time interval, the ions are excited with a degree of excitation of at least 100%.

4. The method of claim 1, wherein, before or in the first measuring time interval, the ions are excited with a degree of excitation of at least 100%.

5. The method of claim 1, further comprising, during the removal of the excited ions from the FT ion trap, determining an overall amount of ions of the removed excited ions.

6. The method of claim 5, further comprising assigning the ion frequencies in the first frequency spectrum an individual amount of ions on the basis of the determined overall amount of ions.

7. The method of claim 1, wherein the ions are excited before or in the first measuring time interval with a degree of excitation of less than 100%.

8. The method of claim 1, wherein the first measuring time interval and the second measuring time interval follow one another with a time difference of less than 10 ms.

9. The method of claim 1, wherein one of the following holds:

a time period from the beginning of the first measuring time interval to the end of the second measuring time interval is less than 500 ms; and a time period from the beginning of the second measuring time interval to the end of the first measuring time interval is less than 500 ms.

10. The method of claim 1, wherein IFT excitation is used to selectively excite the ions depending on a mass-to-charge ratio of the ions.

11. The method of claim 1, further comprising identifying as interference frequencies of the first frequency spectrum:

frequencies contained in the first frequency spectrum that lie in a frequency range in which no excitation of ions takes place; or an excitation of ions with a degree of excitation of more than 100% takes place.

12. A method, comprising:

exciting ions of a gas in an FT ion trap;

recording a first frequency spectrum comprising: a) peaks corresponding to ion frequencies for ion signals generated by the excited ions; and b) peaks corresponding to interference frequencies;

recording a second frequency spectrum comprising peaks corresponding to the interference frequencies of the first frequency spectrum but not peaks corresponding to ion frequencies for ion signals generated by the excited ions; and comparing the first and second frequency spectra to identify the interference frequencies of the first frequency spectrum.

13. A mass spectrometer, comprising:

an FT ion trap;

a detector configured to record:

a first frequency spectrum in a first measuring time interval during or after excitation of ions in the ion trap, the first frequency spectrum comprising peaks corresponding to ion frequencies for ion signals generated by the excited ions and peaks corresponding to interference frequencies; and a second frequency spectrum in a second measuring time interval, the second frequency spectrum comprising the peaks corresponding to the interference frequencies of the first frequency spectrum but not peaks corresponding to ion frequencies for ion signals generated by the excited ions, wherein the detector is configured to identify the interference frequencies of the first frequency spectrum by comparing the first and second frequency spectra.

14. The mass spectrometer of claim 13, wherein excited ions are removed from the FT ion trap at the beginning of the second measuring time interval or before the second measuring time interval.

15. The mass spectrometer of claim 14, wherein excited ions are removed from the FT ion trap at the end of the first measuring time interval.

16. The mass spectrometer of claim 14, wherein the detector is configured to determine an overall amount of ions of the removed excited ions during the removal of the excited ions from the FT ion trap.

17. The mass spectrometer of claim 16, wherein the detector is configured to assign a respective individual amount of ions to the ion frequencies in the first frequency spectrum on the basis of the overall amount of ions determined.

18. The mass spectrometer of claim 13, wherein the ions are excited via a selective IFT excitation dependent on a mass-to-charge ratio of the ions.

* * * * *